US006602022B1

(12) United States Patent
Wilkins

(10) Patent No.: US 6,602,022 B1
(45) Date of Patent: Aug. 5, 2003

(54) DRIVE-ON BOAT DOCKING APPARATUS, METHOD AND KIT FOR CREATING SUCH APPARATUS

(76) Inventor: James F. Wilkins, 860 Cedar Cove Rd., Henderson, NC (US) 27537

( * ) Notice: Subject to any disclaimer, the term of this patent is extended or adjusted under 35 U.S.C. 154(b) by 0 days.

(21) Appl. No.: 10/178,396

(22) Filed: Jun. 24, 2002

(51) Int. Cl.[7] ..... B63C 3/02
(52) U.S. Cl. ..... 405/3; 405/4; 405/7; 114/263
(58) Field of Search ..... 405/1, 3, 4, 5, 405/7; 114/44–46, 48, 263, 343, 344; 414/469, 477

(56) References Cited

U.S. PATENT DOCUMENTS

| | | | | | |
|---|---|---|---|---|---|
| 2,821,315 | A | * | 1/1958 | Bucher | 414/477 |
| 3,056,520 | A | * | 10/1962 | Rutigliano | 414/479 |
| 3,227,292 | A | | 1/1966 | Jacobs | 214/1 |
| 3,380,607 | A | * | 4/1968 | Dale | 414/477 |
| RE27,090 | E | | 3/1971 | Rutter | 61/65 |
| 3,951,087 | A | * | 4/1976 | Carson | 405/3 |
| 4,286,346 | A | * | 9/1981 | Wiek | 414/477 |
| 4,286,906 | A | * | 9/1981 | Robertson | 414/477 |
| 4,601,606 | A | | 7/1986 | Eason | 405/1 |
| 5,183,282 | A | * | 2/1993 | Smyly, Sr. | 414/477 |
| 5,184,913 | A | | 2/1993 | Meriwether | 405/1 |
| 5,544,611 | A | * | 8/1996 | Fahringer et al. | 114/343 |
| 5,641,242 | A | | 6/1997 | Riviere | 405/3 |
| 5,687,663 | A | * | 11/1997 | Wahlstrand | 405/3 |
| 6,164,236 | A | * | 12/2000 | Liu | 114/343 |

FOREIGN PATENT DOCUMENTS

| | | | | |
|---|---|---|---|---|
| JP | 01262284 | * | 10/1989 | 405/1 |

OTHER PUBLICATIONS

Jetddock Trade Literature, undated.
EZ Dock Trade Literature, undated.
EZ Port Trade Literature, undated.

* cited by examiner

*Primary Examiner*—Jong-Suk (James) Lee
(74) *Attorney, Agent, or Firm*—Olive & Olive, P.A.

(57) ABSTRACT

An apparatus for lifting and storing a boat above the water in the well of a floating dry dock is made up of a frame onto which the boat can be driven under its own power and which pivots on a rear bar mounted across and away from the entrance of the well. After being loaded on the frame, the boat and frame are tilted such that the frame is made to bear on a second bar located further away from the well entrance. A method of forming the apparatus and a kit containing the apparatus is also disclosed.

17 Claims, 7 Drawing Sheets

DRIVE-ON BOAT DOCKING APPARATUS, METHOD AND KIT FOR CREATING SUCH APPARATUS

FIELD OF THE INVENTION

This invention relates to apparatus suited to being mounted within the "U" of a U-shaped floating dock for the purpose of docking and elevating a pleasure boat and further relates to a method and a kit for creating such apparatus.

BACKGROUND OF INVENTION

Various apparatus have been devised for dry-docking pleasure boats. Pleasure boats of the kind to which the present invention is particularly adapted are thought of, for purpose of the present description, as being generally within the range of about fifteen feet to twenty-four feet in length and within the range of about 800 pounds to 6000 pounds in weight. Apparatus for docking pleasure boats has been associated with both non-floating as well as floating docks. The use of such apparatus is intended to facilitate removal of a boat from the water, maintaining the boat in a stored position elevated above the water, and for launching of the boat into the water.

A popular kind of dock floats on the water and forms a U-shaped well into which the boat can be driven when it is desired to tie the boat to the dock. U.S. Pat. No. RE 27,090 illustrates an air-powered dry-docking and lifting apparatus which can be installed in an already existing boat well forming part of what appears to be a non-floating dock. It has also been known to provide a ground mounted pivotal frame onto which a boat can be winched into position and then lifted out of the water by pivoting the frame. U.S. Pat. No. 3,227,292 illustrates one such pivotal frame arrangement for a ground-mounted boat ramp. U.S. Pat. No. 4,601,606 illustrates a floating boathouse equipped with a pivotal frame onto which a boat is partially positioned under its own motive power and fully positioned by use of a winch which also serves to pivot the frame and thereby move the boat into an elevated position out of the water. In U.S. Pat. No. 5,641,242, there is shown an apparatus made part of a floating dock having a well. The apparatus of the '242 patent incorporates two frames, one of which is stationary and secured within the well and the other of which pivots on the stationary frame. A winch is employed to pull the boat and position the boat on rollers mounted on the pivotal frame. After the boat has been properly positioned, the winch is used to pivot the frame and move the boat into an elevated position out of the water. Of particular significance in considering the apparatus of the '242 patent is the fact that the motive power of the boat itself cannot be used to load the boat onto the pivotal frame.

Another type of docking apparatus, illustrated in U.S. Pat. No. 5,682,833, utilizes a floating dock made up of hollow flotation inserts and one such system is sold under the trademark "JETDOCK"™. A small, personal watercraft is docked by being driven onto tubes mounted on the dock itself In another system sold under the trademark "EZPORT"™, a small boat is winched onto a roller bed which serves as a dock and forms part of a buoyant floating dock.

With the above background, it can be observed that there is not presently available a docking apparatus which can be very quickly and easily installed in a well enclosed by a U-shaped floating dry dock and which enables a boat to be placed in position for storage above the water level and launched back into the water from such storage position by use of the motive power of the boat itself.

With the foregoing in mind, the primary object of the invention becomes that of providing apparatus of simple construction which can be mounted within the well of an existing floating dock and which incorporates a single pivotal frame onto which the boat can be driven and positioned ready for storage using only the motive power of the boat itself and which can be pivoted so as to either elevate the boat above the water for storage or discharge the boat into the water for further use.

Another object is that of providing a method and kit for creating the described apparatus. Other objects will become apparent through the description to follow.

SUMMARY OF THE INVENTION

An apparatus is provided comprising a rectangular frame, adjustably supported laterally spaced support pads mounted on and running lengthwise of the frame and adapted to receive the hull of a boat, a rear bar on which the frame is pivotally mounted extending across and having its ends secured to a floating dry dock on opposite sides of a well in a manner which permits load on the rear bar to be evenly distributed on the dock and a front bar having its ends secured to the sides of the well and extending across the well at a location forward of the rear bar. The method of creating the described apparatus utilizing the mentioned frame, rear and front bars and a kit made up of such parts with instructions for assembling such parts also constitute part of the invention.

DETAILED DESCRIPTION OF THE PREFERRED EMBODIMENTS

Figure 1:
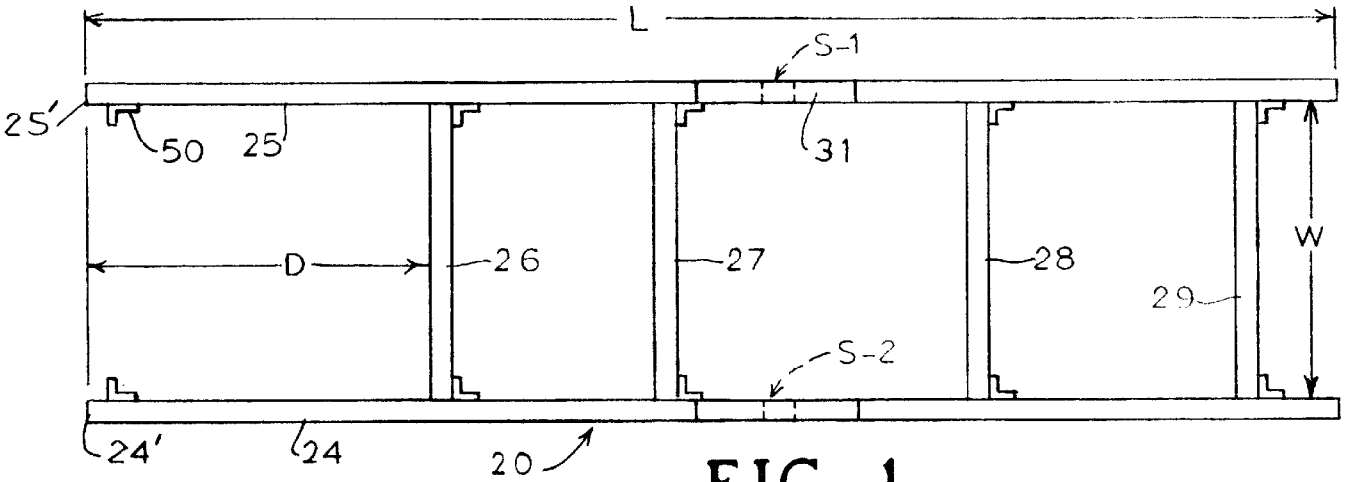
FIG. 1 is a plan view of the frame used with the invention assembly but stripped of its support pads.

The apparatus 15 of the invention suited for use with pleasure, fishing and pontoon boats basically comprises three principal components namely a frame 20, a rear bar 30 on which an intermediate portion of frame 20 pivots and a front bar 40 on which the front of frame 20 rests whenever frame 20 is supporting a stored boat elevated above the level of water. While the length and width of frame 20 may vary, in the illustrated embodiment, frame 20 (FIG. 1) is made of galvanized steel metal and has a length L of fourteen feet and an inside width W of forty inches.

Figure 4:
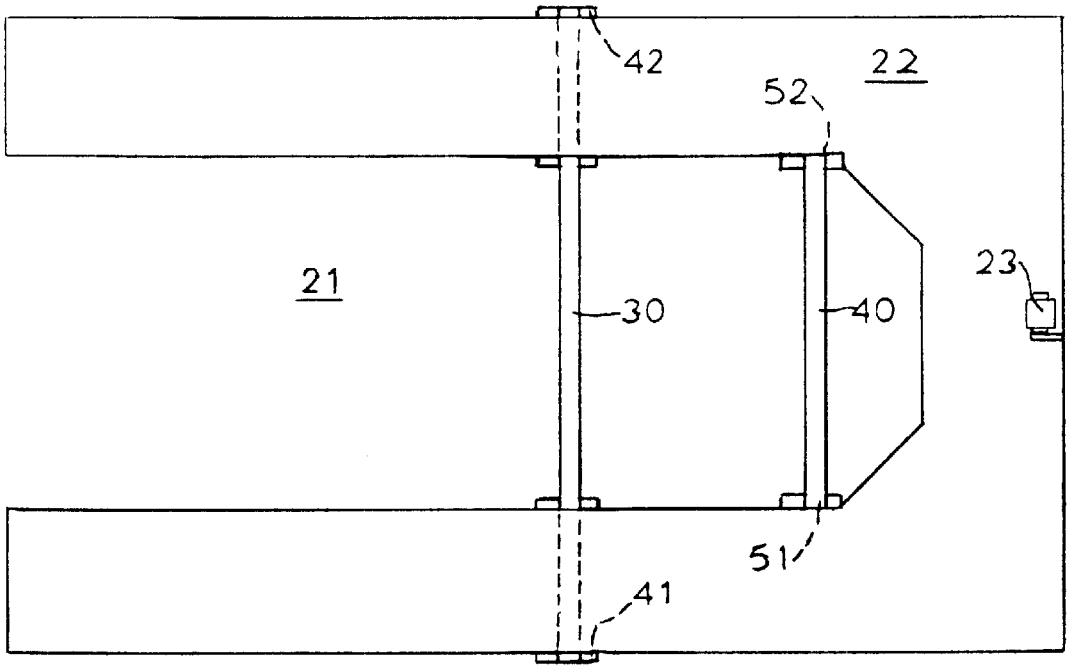
FIG. 4 is a plan view of a floating dock having a U-shaped well and fitted with the front and rear bars of the invention and a winch.
Figure 5:
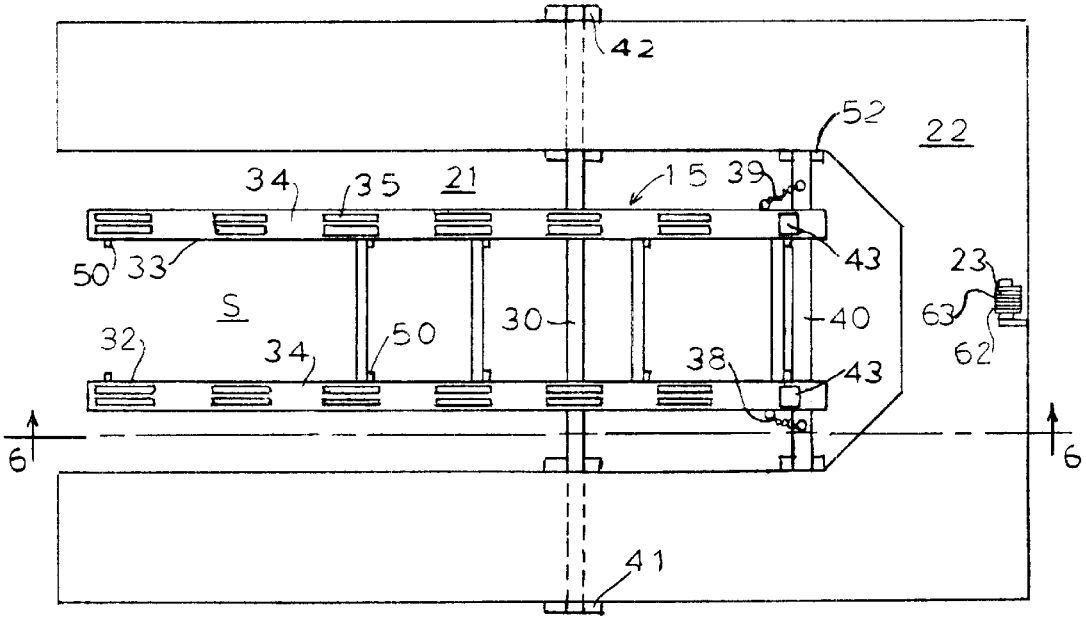
FIG. 5 is a plan view of the floating dock of FIG. 4 fitted with the frame, front and rear bars of the invention and indicating the frame as being pivotally mounted on the rear bar.
Figure 7:
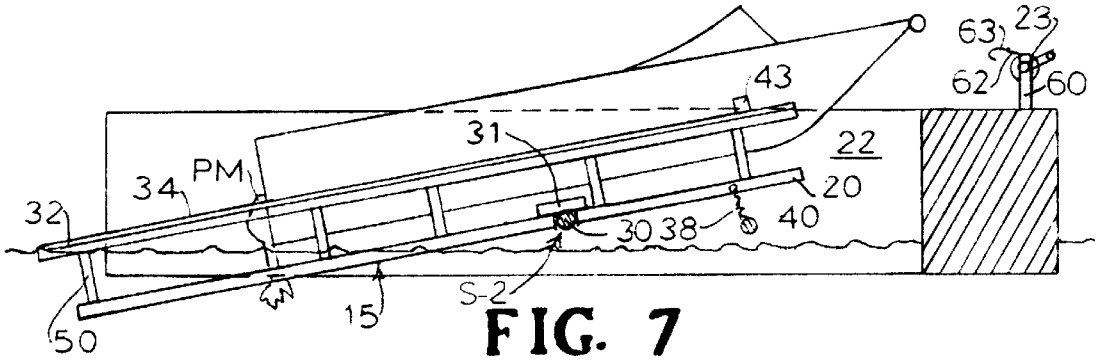
FIG. 7 is a side elevation section view taken in the direction of line 6—6 of FIG. 5 and illustrating the frame positioned after the boat has been driven onto the frame under its own motive power.
Figure 10:
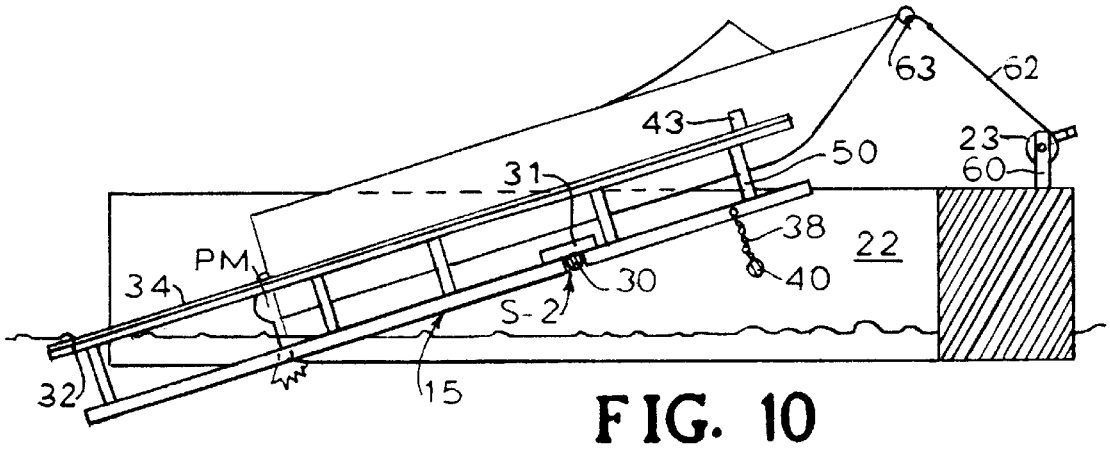
FIG. 10 is a side elevation section view taken in the direction of line 6—6 of FIG. 5 illustrating the frame at its higher position of FIG. 9 with the frame above the water and after the boat has been driven onto the frame in its stored position under its own motive power and has been secured to the winch.

The three components of the invention apparatus 15 mentioned above are adapted to be installed in a well 21 formed in a floating dry dock 22, illustrated as being of a U-shape in FIG. 4, and as later explained are used in conjunction with a winch 23. With this background, a description will now be given of each of the components and the manner in which they work together to provide a docking apparatus that enables a boat to be docked and positioned for storage on the frame 20 using the motive power of the boat and thereafter elevated above the water by tilting of the frame 20 on rear bar 30. A typical tiltable, outboard propulsion motor PM is schematically illustrated in FIGS. 7 and 10 in a lowered position and in FIGS. 8 and 11 in a raised position.

Figure 2:
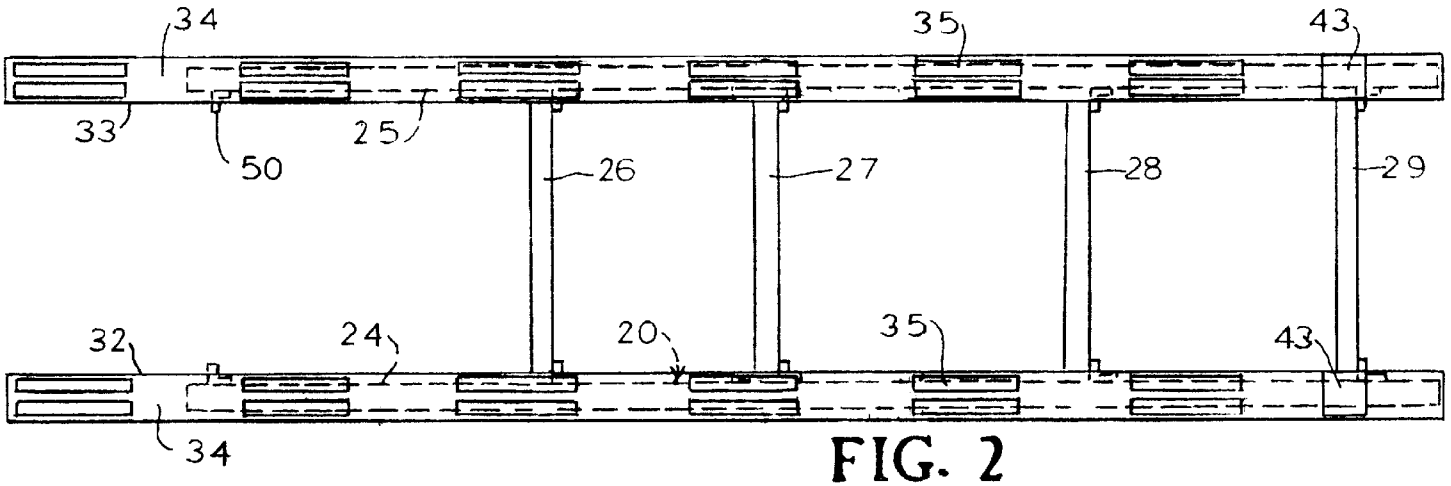
FIG. 2 is a plan view of the frame fitted with support pads and on the support pads spaced apart low friction auxiliary bunk pads.
Figure 11:
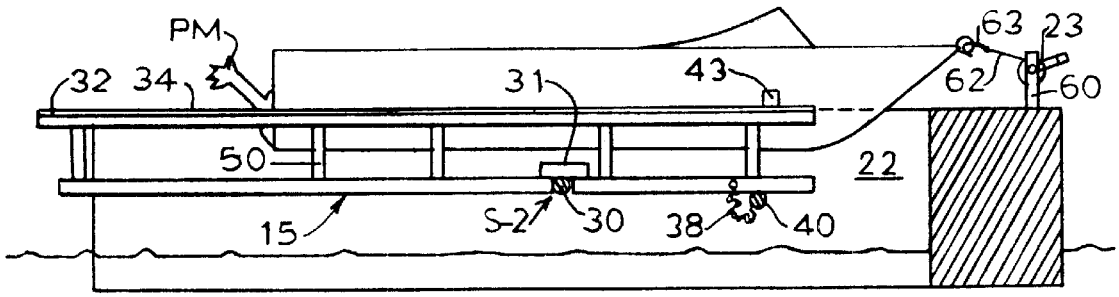
FIG. 11 is a side elevation section view taken in the direction of line 6—6 of FIG. 5 illustrating the frame at its FIGS. 9 and 10 higher position with the frame positioned, by use of a winch, so as to rest on the front bar and with the boat elevated above the water.

Referring initially to FIG. 11 frame 20 comprises a pair of parallel laterally spaced metal sides rails 24, 25 joined by longitudinally spaced apart cross bars 26, 27, 28 and 29 connected to rails 24, 25 by welding, bolts or other suitable means. Slots S-1 and S-2 are formed by spaced apart sections of rails 24, 25 joined by bars 31 to receive rear bar 30 and about which frame 20 pivots. The trailing cross bar 26 is purposely positioned at a distance D from the trailing ends 24', 25' of rails 24, 25 which enables the boat in the examples of FIGS. 5–8 to be driven onto the frame and positioned for storage using only the motive power of the boat as explained more fully below. Bumpers 43 (FIG. 2) limit forward travel of the boat on rails 24, 25.

Figure 3:
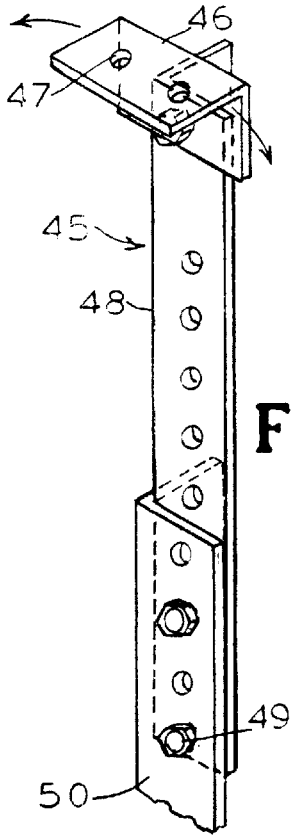
FIG. 3 is a perspective view of an adjustable support board bracket and a portion of the frame to which the bracket is attached.

Continuing with the description of frame 20, it will be noted that frame 20 mounts a pair of longitudinally extending boards 32, 33 preferably covered with carpet 34, typically of outdoor carpet grade, and supported by vertically adjustable, pivotal board mounts 45, see FIG. 3, which are positioned according to the shape of the boat being docked. Each of the boards 32, 33 is supported on mounts 45 with each having an integral bearing plate 46 with fastener holes 47 and supported on vertical angle plate 48 by fasteners 49 to vertical upright angle supports 50 on frame 20.

Boards 32, 33 are longer in length than that of frame 20 which reduces the required amount of frame tilt. Carpet 34 preferably mounts a series of so-called bunk pads 35 which provide low friction slide surfaces and are commonly used on boat trailers.

Rear bar 30, in the illustrated first embodiment comprises a galvanized steel, metal pipe whose ends are mounted outwardly of well 21 and below dock 22 by means of suitable fasteners 41, 42 such as U-hooks, clamps or the like suited for rigidly securing the outer ends of rear bar 30 to an outer bottom surface of dock 22 such that the weight imposed on rear bar 30 is distributed on dock 22 outwardly of well 21.

Front bar 40, which takes less of the load of the boat in the illustrated embodiment, comprises a galvanized steel, metal pipe which is mounted within well 21 by means of metal brackets 51, 52.

Having described the three principal components of the invention apparatus, it should be recognized that the invention apparatus 15 operates in conjunction with a winch 23 illustrated as comprising a dock mounted stand 60 having a conventional winch drive 61, cable 62 and hook 63.

Figure 8:
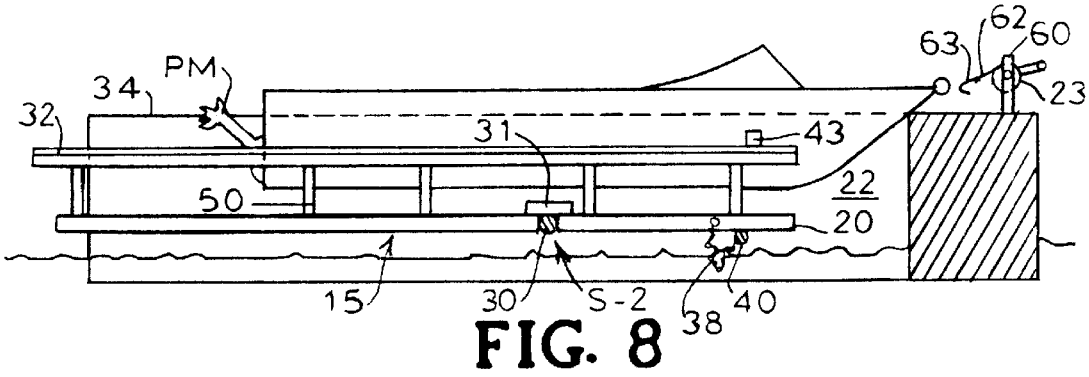
FIG. 8 is a side elevation section view taken in the direction of line 6—6 of FIG. 5 and illustrating the frame positioned, without use of a winch, and with the boat in its stored position elevated above the water.
Figure 9:
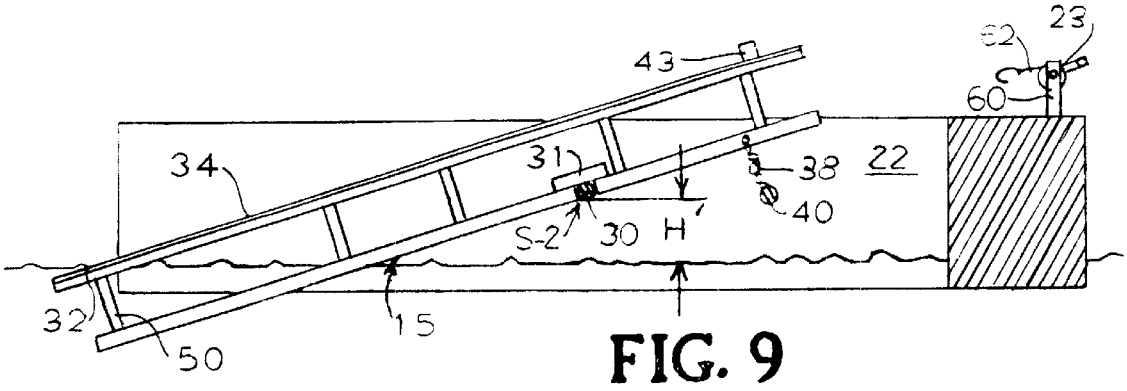
FIG. 9 is a side elevation section view taken in the direction of line 6—6 of FIG. 5 and illustrating in a second embodiment the front and rear bars elevated at a higher position above the water than as illustrated in FIG. 6

Here it may be noted in the first embodiment of FIGS. 5–8 the rear bar 30, on which frame 20 tilts, is assumed to be at a relatively low height H (FIG. 6) of about six inches above the water whereas in the second embodiment examples of FIGS. 9–11 the rear bar 30 on which frame 20 tilts is assumed to be at a relatively higher height H' (FIG. 9) of about twelve inches above the water. Here it may be noted that the load of the boat on the invention apparatus will cause the dock itself as well as the invention apparatus 15 to sink down a few inches, typically about two inches. In both embodiments, i.e. whether rear bar 30 is at height H (FIG. 6) or H' (FIG. 9), the boat can be,put into its stored position on frame 20 by use of the motive power PM of the boat and with upward tilt of frame 20 being limited by the adjustable safety chains 38 and 39. In the case of the first embodiment, when the boat is driven on and positioned on frame 20 as in FIG. 7 the frame 20 and the boat will normally be automatically tilted downward to rest on front bar 40 without requiring use of winch 23 to move the boat to the storage position of FIG. 8. However, when the rod 30 is desired to be at the higher position H' (FIG. 9) and particularly when the boat is relatively heavy, use of the winch 23 to pull the boat down to its stored position as illustrated in FIGS. 10 and 11 may be found necessary but in neither case is winch 23 required to be used to position the boat in its initial position on frame 20. In both embodiments, when the boat is launched back into the water, lowering and use of the motive power PM of the boat in reverse will pull the boat off the frame 20.

Figure 6:
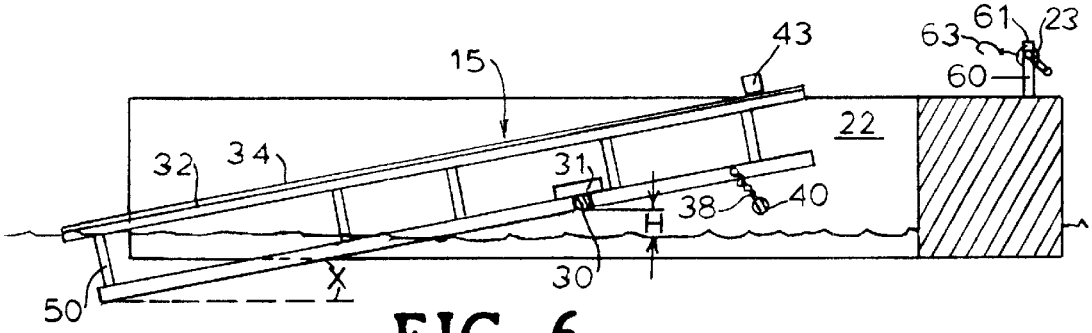
FIG. 6 is a side elevation section view taken in the direction of line 6—6 of FIG. 5 and illustrating the frame positioned ready to receive a boat.

As best illustrated by FIGS. 6–8, the frame 20 by reason of a major portion of its length and its center of gravity being rearward of bar 30 is initially positioned in a tilted position at an appropriate acute angle X (FIG. 6) of ten degrees or less and preferably of about three to eight degrees. Frame 20, because of the location of slots S-1, S-2, tends to tilt upwardly as seen in FIG. 6 and such upward tilt is limited by the previously mentioned pair of adjustable chains 38, 39. With frame 20 so positioned, the boat operator approaches the frame 20 and by use of the boat's motive power drives the boat onto frame 20 with the propeller drive going into the open end S shown in FIG. 5. The boat power is cut off once the boat has assumed the position in which it is to be stored and at which stage the boat operator raises the propeller drive out of the water and gets out of the boat. The boat is now ready for storage. Frame 20, when mounted at the height H (FIG. 6), would normally be expected to tilt downwardly on its own so as to rest on front bar 40 once the boat reaches the position shown in FIG. 7 and the propeller drive has been raised out of the water.

As previously stated, winch 23 is used when frame 20 is mounted at height H' to pull the boat and frame into the down position of FIG. 11. Once the operator raises the propeller drive out of the water, the operator gets out of the boat and hooks the boat to winch 23 by means of hook 63 (see FIG. 10) and cable 62 and operates winch 23 to pull the boat into the FIG. 11 position.

When it is desired to launch the boat back into the water, from the FIG. 11 position, the winch cable is unhooked or loosened which permits frame 20 to tilt down to the position of FIG. 10 to the extent allowed by chains 38, 39. The boat operator then drops the propeller drive into the water, unhooks the winch cable if hooked starts the motor and backs off the frame.

Figure 12:
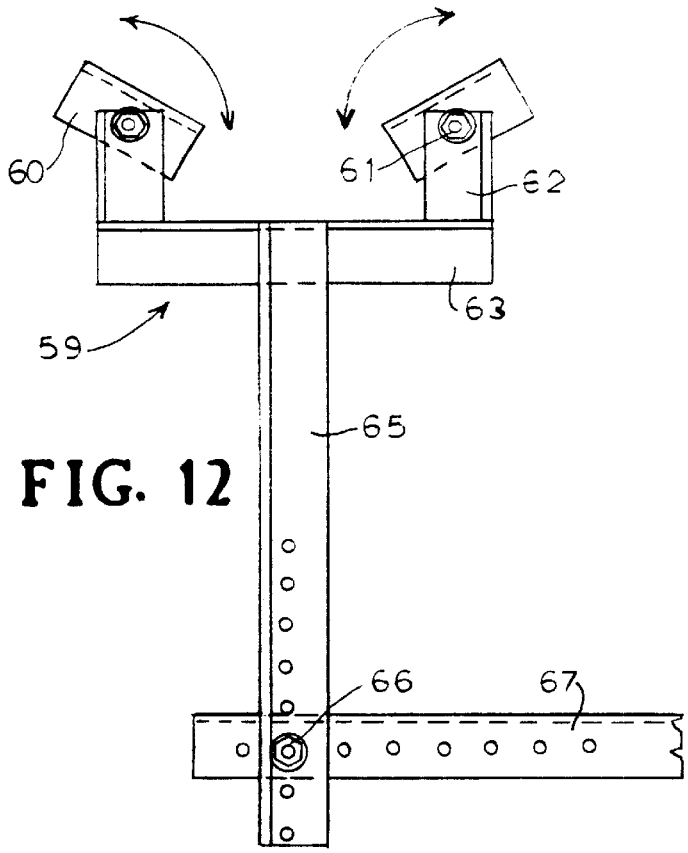
FIG. 12 is a perspective view of an adjustable support pad bracket for use in a third embodiment with a pontoon type boat and showing a portion of the frame to which the bracket is attached.
Figure 13:
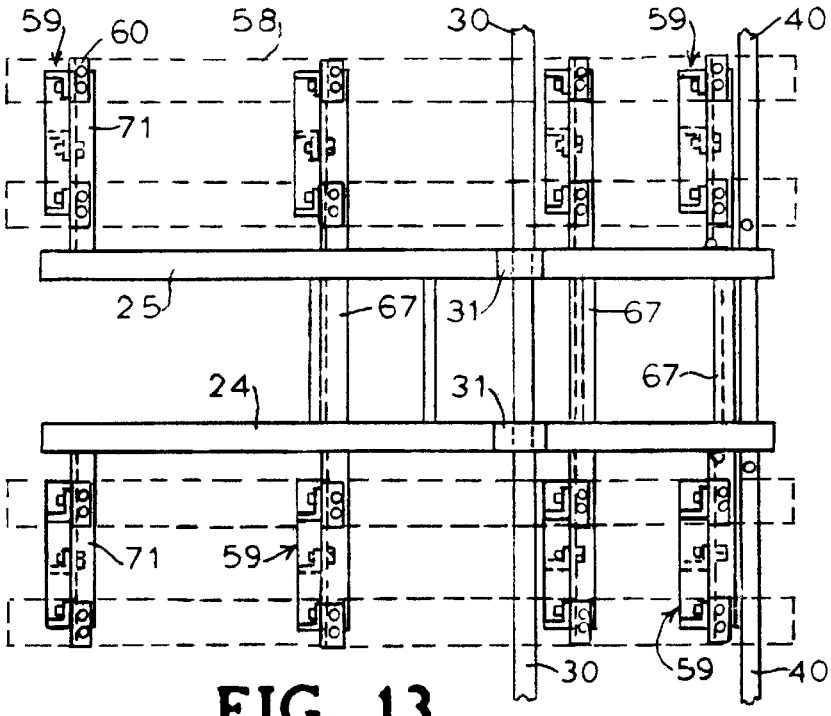
FIG. 13 is a plan view illustrating how a plurality of the pontoon boat brackets of FIG. 12 are mounted on the frame.
Figure 14:
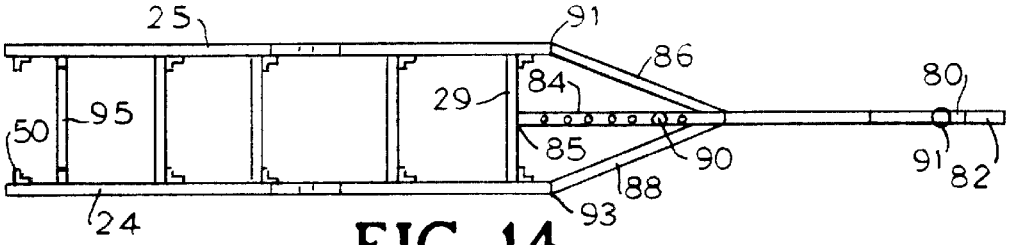
FIG. 14 is a plan view of a frame modified according to a fourth embodiment.
Figure 15:
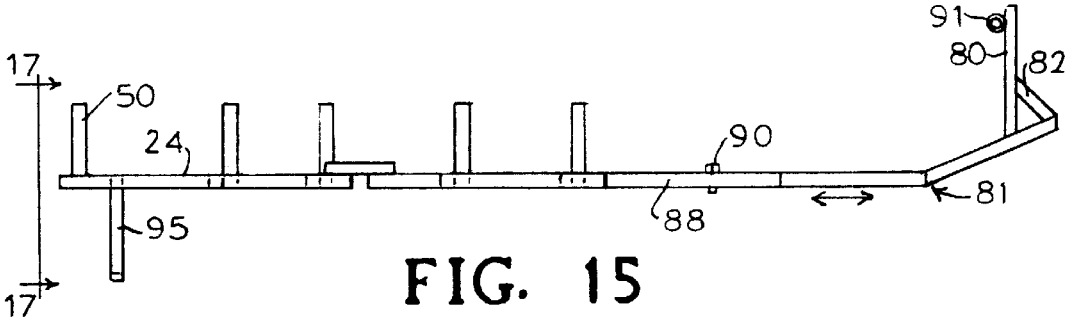
FIG. 15 is a side elevation view of the frame of FIG. 14.
Figure 16:
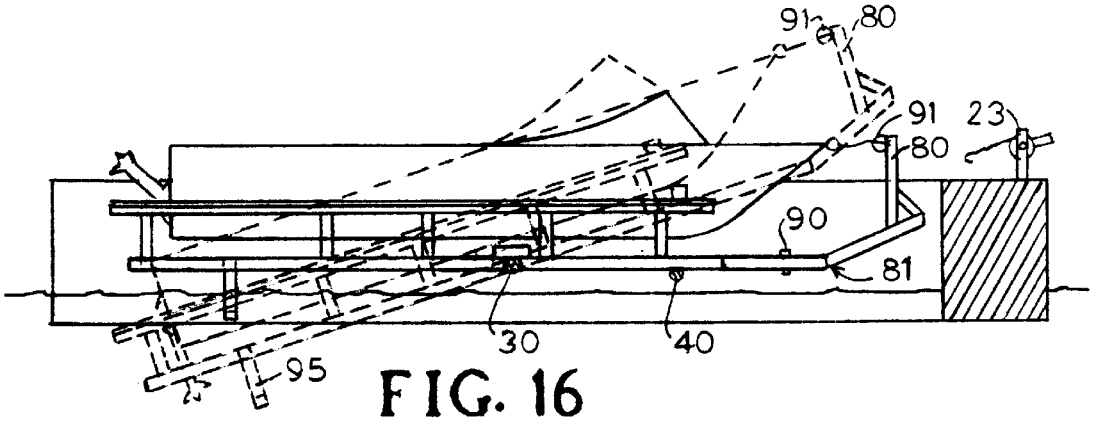
FIG. 16 is a side elevation view of a boat shown on the FIG. 14 frame as initially positioned in dotted lines and as finally positioned in solid lines.
Figure 17:
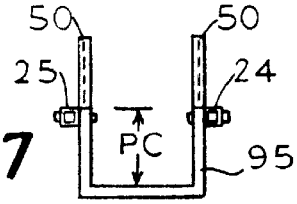
FIG. 17 is a view taken in the direction of line 17—17 in FIG. 15 of a bracket attached to the rear end of the frame of FIG. 14.

As best illustrated by FIGS. 12 and 13, the invention apparatus adapts to docking pontoon type boats as well as conventional boats. In this regard, FIG. 12 is a perspective view of an adjustable support board bracket 59 for receiving a pontoon-equipped boat. The boards 58 are shown in dashed lines in FIG. 13. In FIG. 12, the boards (not shown) are mounted on pivotal bearing plates 60 secured by bolts 61 and supported on uprights 62 mounted on cross bar 63 which in turn mounts on vertical bar 65 adjustably secured by bolts 66 to frame members 67 and 71.

Also to be noted is that the docking apparatus of the invention lends itself to being sold as a kit comprising the frame 20 either assembled or in the form of frame members which can be secured together, a rear bar 30, a front bar 40 and with instructions for installing both bars and the support boards 32, 33. The support boards would normally be expected to be provided by the purchaser of the kit. Thus, with such a kit available to the purchaser and with instructions consistent with what has been described herein, the average customer will be able to very quickly provide himself or herself with a docking apparatus having all the advantages set forth below.

A modification of the docketing apparatus of the invention particularly useful for large boats is illustrated as a third embodiment in FIGS. 14–17. In this regard, it has been found that large boats when positioned on tilted frame 20 as in FIGS. 7 and 10 may have a tendency to slip backwards and in doing so may tend to spread apart the trailing portion of rails 24, 25. To accommodate to this situation and as seen in FIGS. 14–17, an upright member 80 mounts on an upwardly bent tubular structure 81 braced by brace 82 and which is received in a telescoping relation by a mating tube 84 having a rear end portion 85 welded to cross bar 29 and a forward portion welded to angled brace members 86, 88 whose rear ends 91, 93 are welded to the leading ends of side rails 24, 25. The rear end of tubular structure 81 telescopes within the mating tube 84 both of which have a series of holes (FIG. 14) adapted to receiving a bolt 90 thereby enabling upright 80 and its associated welded-on tie ring 91 to be adjustably positioned to accommodate to the length of the boat being launched. To resist any tendency of the rails 24, 25 to spread apart when receiving a relatively heavy boat, a downwardly extending U-shaped brace 95 secured to rails 24, 25 has a propeller clearance PC (FIG. 17) below frame 20 of about 24 inches sufficient to permit the boat's propulsion apparatus PM to pass when in the water and being used to dock the boat. Brace 95 is made of sufficiently heavy metal construction to prevent spreading of rails 24, 25 when loaded with a heavy boat.

Before a particular boat is positioned, the operator will have properly positioned and locked together by use of pin 90 (FIG. 15) tube 81 in tube 84 corresponding to the length of the boat. Then immediately after the boat is positioned as in the dotted line position of FIG. 16, the operator will tie the bow of the boat to the ring 91 on upright 80 and after which the boat will typically be winched down to rest on front bar 40.

In summary, the following advantages are achieved by the docking apparatus of the invention:

1. It is easily and quickly installed in a well of an existing floating dock simply by installing the front and rear bars and mounting the frame on the rear bar.
2. It is self-loading irrespective of the water level.
3. It readily adapts to docking a wide range of boats, including pontoon boats, of different length and weight and particularly of the type in which the propulsion apparatus is normally positioned or is adapted to be positioned above the bottom of the boat.
4. It is operable by a single individual.
5. It adapts to a do-it-yourself kit and installation procedure.
6. Relatively heavy boats may be prevented from sliding rearwardly on the frame once positioned by the boat's propulsion apparatus.

What is claimed is:

1. An apparatus adapted for being installed in a well having an open entrance and bounded by sides of a floating dry dock for receiving, supporting and elevating a boat of the type having positionable propulsion means mounted proximate the stern of the boat and normally submerged during use to a depth extending below the bottom of the boat, comprising:

(a) a single frame, a major portion of said single frame being rectangular and having a forward end; a second opposing rear end, side members joined together and extending between said forward and rear ends, said side members being adapted for mounting adjustable support means extending longitudinally and outwardly of said frame for contacting and supporting the bottom surface of said boat in conformance with its shape and said rear end of said frame being formed so as to permit forward passage of said propulsion means between said side members during positioning of said boat on and within the length of said frame by said propulsion means;

(b) a rear bar member located forward of the entrance to said well and extending across and terminating at each of opposite ends outwardly of opposite sides of said well, said opposite ends being secured to said dock and being operative by reason of such securement to distribute load placed thereon across said dock, said frame being pivotally mounted on said rear bar member such that said major portion of the length of said frame is disposed rearwardly of said rear bar member and the weight of said frame is distributed in a manner which tends to cause the trailing said rear end of said frame when not having said boat mounted thereon to pivot downwardly into water confined at the entrance to said well, and said forward end to pivot upwardly and with the plane of said frame being at an acute angle not in excess of ten degrees relative to the plane of said dock;

(c) a front bar member extending across said well and positioned parallel to and forward of said rear bar member and having outer ends secured to said dock;

(d) said frame, rear and front bar members being arranged such that said boat with said frame tilted upwardly may be driven by its operator while in said boat onto said frame support means by use of said propulsion means and positioned within the length of said frame for storage and then drawn down by pivoting said frame on said rear bar member to bring said forward end of said frame down to rest on said front bar member; and (e) wherein said frame includes a downwardly extending frame strengthening bar member connected between said side members proximate said frame rear end and shaped to permit said forward passage of said propulsion means.

2. An apparatus as claimed in claim 1 wherein said support means comprise rectangular boards on which said boat is supported.

3. An apparatus as claimed in claim 2 wherein said support means are adjustably mounted on said side members of said frame.

4. An apparatus as claimed in claim 1 wherein said frame side members are made up of frame sections crossly secured together to form said frame and said frame sections include opposing recesses on the joins of said sections for receiving said rear bar member.

5. An apparatus as claimed in claim 1 wherein said boards include material covering surfaces contacted by said boat bottom surface when on said frame.

6. An apparatus as claimed in claim 1 wherein the length of said boards are longer than the length of said frame.

7. An apparatus as claimed in claim 1 wherein said acute angle is within the range of about three to eight degrees.

8. An apparatus as claimed in claim 1 wherein the boat being docked and elevated by said apparatus has a length within the range of about 10 to 28 feet and a weight within the range of about 800 to 6000 pounds.

9. An apparatus as claimed in claim 1 wherein said boat comprises a pontoon boat and said adjustable support means comprise adjustable support means adapted to mount pontoons of said boat.

10. An apparatus as claimed in claim 1 wherein said frame includes at said forward end an adjustably positioned post member to which the bow of said boat can be secured to prevent slippage of said boat on said adjustable support means.

11. A kit of components suited to forming an apparatus which can be installed in a well of a floating dry dock for lifting out of and storing a boat above water confined in said well, said boat being of a type having propulsion means mounted proximate the stern of said boat and which during use is normally submerged to a depth extending below the bottom of said boat comprising:

(a) a first bar member adapted for having its ends secured to said dock and for being located across said well forwardly of its entrance to establish a first bar support;

(b) a second bar member adapted for having its ends secured to said dock and for being located across said well forwardly of said location of said first bar member to establish a second bar support parallel to said first bar support;

(c) means for forming a frame, a major portion of said frame being rectangular and having a forward end, a second opposing rear end, side members joined together and extending between said forward and rear ends, a downwardly extending frame strengthening bar member connected between said side members proximate said frame rear end and shaped to permit forward passage of said propulsion means, and mounting longitudinal extending adjustable support means adapted to contact and conform with the shape of the bottom surface of said boat; and (d) a set of instructions directed to installing said first and second bar members, forming said frame, installing said support means and instructing a user on how to pivotally mount said frame so as to cause said frame to pivot from an upwardly tilted position on said first bar and be brought to rest on said second bar after receiving said boat in a position within the length of said frame as determined by use of said propulsion means and while being driven by its operator while in said boat.

12. A method for forming an apparatus suited to being installed in a well of a floating dry dock for lifting out of and storing a propulsion driven boat above water, comprising:

(a) forming a first bar and securing its ends to the dock at a location such that it extends across said well away from its entrance;

(b) forming a second bar and securing its ends to said dock such that it is parallel to said first bar and extends across said well at a location which is further away from its entrance than is the location of said first bar;

(c) forming a single frames a major portion of said single frame being rectangular and having a forward end, a rear end and side members extending between said forward and rear ends, a downwardly extending frame strengthening bar member connected between said side members proximate said frame rear end, said rear end and said strengthening bar member being formed so as to permit forward passage of the propulsion drive of said boat between said members;

(d) forming longitudinal extending adjustable support means adapted to contact and conform with the shape of the bottom surface of said boat and mounting said support means on said side members of said frame; and (e) pivotally mounting said frame on said first bar in a position such that said major portion of said frame is located rearwardly of said first bar and said frame is suited to assume an upwardly tilted position prior to said boat being driven by its operator while in said boat onto said frame support means by said propulsion drive and located within the length of said frame followed by said frame being drawn down to cause said forward end to rest on said second bar.

13. An apparatus adapted for being installed in a well having an open entrance and bounded by sides of a floating dry dock for receiving, supporting and elevating a boat of the type having positionable propulsion means mounted proximate the stern of said boat and normally submerged during use to a depth extending below the bottom of said boat, comprising:

(a) a single frame, a major portion of said single frame being rectangular and having a forward end, a second opposing rear end, side members joined together and extending between said forward and rear ends, said side members being adapted for mounting adjustable support means extending longitudinally and outwardly of said frame for contacting and supporting the bottom surface of said boat in conformance with its shape and said rear end of said frame being formed so as to prevent spreading apart of said side members but to permit forward passage of said propulsion means between said side members during positioning of said boat on and within the length of said frame by said propulsion means;

(b) a rear bar member located forward of the entrance to said well and extending across and terminating at each of opposite ends outwardly of opposite sides of said well, said opposite ends being secured to said dock and being operative by reason of such securement to distribute load placed thereon across said dock, said frame being pivotally mounted on said rear bar member such that said major portion of the length of said frame is disposed rearwardly of said rear bar member and the weight of said frame is distributed in a manner which tends to cause the trailing, said rear end of said frame when not having said boat mounted thereon to pivot downwardly into water confined at the entrance to said well, and said forward end to pivot upwardly and with the plane of said frame being at an acute angle not in excess of ten degrees relative to the plane of said dock;

(c) a front bar member extending across said well and positioned parallel to and forward of said rear bar member and having outer ends secured to said dock; and (d) said frame, rear and front bar members being arranged such that said boat may be driven by its operator while in said boat onto said frame support means by use of said propulsion means and positioned within the length of said frame for storage and then drawn down by pivoting said frame on said rear bar member to bring said forward end of said frame down to rest on said front bar member.

14. An apparatus as claimed in claim 13, wherein said frame side members include opposing recesses for receiving said, rear bar member and preventing lengthwise movement of said frame on said rear bar member.

15. An apparatus as claimed in claim 13, wherein said acute angle is within the range of about three to eight degrees.

16. An apparatus as claimed in claim 13, wherein said frame includes at said forward end an adjustably positioned post member to which the bow of said boat can be secured to prevent slippage of said boat on said adjustable support means.

17. A method for forming an apparatus suited to being installed in a well of a floating dry dock for lifting out of and storing above water a boat having a positionable propulsion drive, comprising:

(a) forming a first bar and securing its ends to said dock at a location such that it extends across said well away from its entrance;

(b) forming a second bar and securing its ends to said dock such that it is parallel to said first bar and extends across said well at a location which is further away from its entrance than is the location of said first bar;

(c) forming a single frame, a major portion of said single frame being rectangular and having a forward end, a rear end and side members extending between said forward and rear ends, said rear end being formed so as to both permit forward passage of said propulsion drive of said boat between said members and to restrict spreading apart of said members when loaded by the weight of said boat;

(d) forming longitudinal extending adjustable support means adapted to contact and conform with the shape of the bottom surface of said boat and mounting said a support means on said side members of said frame; and (e) pivotally mounting said frame on said first bar in a position such that said major portion of said frame is located rearwardly of said first bar and said frame assumes an upwardly tilted position suited to said boat being driven by its operator while in said boat onto said frame support means under said propulsion drive and located within the length of said frame, followed by said frame being drawn down to cause said forward end to rest on said second bar.

* * * * *